US007069760B2

(12) United States Patent
Jin

(10) Patent No.: US 7,069,760 B2
(45) Date of Patent: Jul. 4, 2006

(54) DEVICE AND METHOD FOR MANUFACTURING A CURVED METAL TUBE OR ROD

(75) Inventor: In Tai Jin, 1219-128 Daeyeon2-dong, Nam-ku, Busan 608-022 (KR)

(73) Assignees: In Tai Jin, Busan (KR); Pukyong National University, Busan (KR)

( * ) Notice: Subject to any disclaimer, the term of this patent is extended or adjusted under 35 U.S.C. 154(b) by 0 days.

(21) Appl. No.: 10/311,029

(22) PCT Filed: May 22, 2001

(86) PCT No.: PCT/KR01/00842

§ 371 (c)(1),
(2), (4) Date: Aug. 6, 2003

(87) PCT Pub. No.: WO01/96039

PCT Pub. Date: Dec. 20, 2001

(65) Prior Publication Data

US 2004/0020260 A1 Feb. 5, 2004

(30) Foreign Application Priority Data

Jun. 10, 2000 (KR) ..... 2000-32554

(51) Int. Cl.
*B21C 25/08* (2006.01)

(52) U.S. Cl. ..... 72/260; 72/259; 72/264; 72/272; 72/370.01

(58) Field of Classification Search ..... 72/256, 72/259, 273, 353.2, 354.6, 354.8, 356, 358, 72/359, 260, 261, 264, 268, 269, 271, 272, 72/370.01, 370.26

See application file for complete search history.

(56) References Cited

U.S. PATENT DOCUMENTS

| | | | | | |
|---|---|---|---|---|---|
| 182,611 | A | * | 9/1876 | Stevenson | 72/260 |
| 368,314 | A | * | 8/1887 | Whitney | 72/259 |
| 867,658 | A | * | 10/1907 | Hoopes et al. | 72/259 |
| 1,916,645 | A | * | 7/1933 | Taylor | 72/260 |
| 2,863,174 | A | * | 12/1958 | Chu et al. | 264/323 |
| 3,267,712 | A | * | 8/1966 | Atkin | 72/260 |
| 4,703,642 | A | * | 11/1987 | Wagner et al. | 72/259 |
| 5,305,626 | A | * | 4/1994 | Tiekink | 72/257 |
| 6,190,595 | B1 | * | 2/2001 | Thoms et al. | 264/177.16 |
| 6,427,509 | B1 | * | 8/2002 | Ouchi et al. | 72/256 |
| 6,470,726 | B1 | * | 10/2002 | Murata et al. | 72/260 |

FOREIGN PATENT DOCUMENTS

| | | | | |
|---|---|---|---|---|
| DE | 2855449 | * | 7/1980 | 72/260 |
| JP | 4-37411 | * | 2/1992 | 72/260 |
| JP | 6-198327 | * | 7/1994 | 72/260 |
| JP | 6-285539 | * | 10/1994 | 72/260 |

* cited by examiner

*Primary Examiner*—Ed Tolan
(74) *Attorney, Agent, or Firm*—Blakely, Sokoloff, Taylor & Zafman; Stephen M. De Klerk

(57) ABSTRACT

The purpose of the present invention is to propose a new way of manufacturing curved metal tubes or rods with arbitrary sections and eliminating the conventional bending defects such as thinning and thickening in the wall of tube, distortion of the section, and wrinkling and folding on the surface by the extrusion bending process that can extrude and weld together one or more billets inside dies cavity, and can bend them during extrusion due to the gradient of extrusion velocities controlled by the eccentricity of the cavity sections between the entrance and the exit of the eccentric conical extrusion bending dies and conical plug, or by the relative size of the holes of multi-hole container, or by the relative moving velocity of multi-punches.

4 Claims, 8 Drawing Sheets

DEVICE AND METHOD FOR MANUFACTURING A CURVED METAL TUBE OR ROD

CROSS-REFERENCE TO OTHER APPLICATIONS

This Application is a National Phase of International Application No. PCT/KR01/00842, filed on May 22, 2001, which claims priority from Korean Patent Application No. 2000/32554, filed on Jun. 10, 2000.

TECHNICAL FIELD

This invention relates to devices for manufacturing a curved metal tube or rod, more particularly to devices for manufacturing a curved metal tube or rod, which can easily and smoothly extrude tube or rod with a desired curvature and which are capable of extruding tubes having various shapes in section and including polygonal and longitudinal fins.

BACKGROUND ARTS

Curved metal tubes or rods have been bended by secondly carrying out a bending process after firstly extruding of straight tubes or rods by the extrusion process. However, it is difficult to get precious and standard curved products, because the curved tube or rod has been caused to have the ununiform section due to deformation during bending the tube or rod. Especially, it is very difficult to manufacture the bended tube having longitudinal fins on an inner surface or an outer surface of the tube as shown in FIG. 8, by using the conventional extruding device, because the conventional extruding device causes the bended tube to have a thin or thick wall at some portion thereof, to have a distorted section, and to be wrinkled and folded on the outer surface thereof.

DISCLOSURE OF INVENTION

Therefore, the present invention has been developed to solve the above-mentioned problems. It is a first object of the present invention to provide devices for manufacturing a curved metal tube, which can easily and smoothly extrude tube with a desired curvature while extruding tubes having various sectional shapes and including polygonal and longitudinal fins.

It is a second object of the present invention to provide devices for manufacturing curved metal rods, which can easily and smoothly extrude rod with a desired curvature while extruding rods having various sectional shapes and including polygonal and longitudinal fins.

It is a third object of the present invention to provide a method for manufacturing a curved metal tube, which can easily and smoothly extrude tube with a desired curvature while extruding tubes having various sectional shapes and including polygonal and longitudinal fins.

It is a fourth object of the present invention to provide a method for manufacturing curved metal rods, which can easily and smoothly extrude rod with a desired curvature while extruding rods having various sectional shapes and including polygonal and longitudinal fins. In order to establish the first object of the present invention, there is provided a device for manufacturing a curved metal tube which comprises: an extrusion punch which has at least one pressing rod, for pressing at least one hot metal billet; a container which has at least one hole corresponding to the number of the pressing rod and which has a plug extending from an end surface thereof and being eccentric from a center portion of the end surface of the container, for receiving the hot metal billet in a respective hole; and an extrusion die having a conical cavity with an opening, the conical cavity being eccentric from an axis extending longitudinally the container and the extrusion die in order for the plug to be placed in the cavity, wherein the conical cavity is defined by an inner surface of the extrusion die, of which the opening has a sectional shape corresponding to that of the plug so that a gap is defined between the inner surface of the extrusion die and surfaces of the plug, the gap having width corresponding to a thickness of the curved tube and wherein the inner surface of the extrusion die has a different gradient corresponding to an incline of the plug to cause the extruded metal tube to be bent.

In order to establish the second object of the present invention, there is provided a device for manufacturing a curved metal rod which comprises: an extrusion punch which has at least one pressing rod, for pressing at least one hot metal billet; a container which has at least one hole corresponding to the number of the pressing rod, for receiving the hot metal billet in a respective hole; and an extrusion die having a conical cavity with an opening, the conical cavity being eccentric from an axis extending longitudinally the container and the extrusion die in order for the metal billet to be placed in the cavity, wherein the conical cavity is defined by an inner surface of the extrusion die, of which the opening has a sectional shape corresponding to that of the metal rod and wherein the inner surface of the extrusion die has a different gradient to cause the extruded rod to be bent.

In order to establish the third object of the present invention, there is provided a method for manufacturing a curved metal tube which comprises the steps of: preparing a container which has at least one hole and a plug extending from an end surface thereof and being eccentric from a center portion of an end surface of the container, and an extrusion die having a conical cavity with an opening, the conical cavity being eccentric from an axis extending longitudinally the container and the extrusion die in order for the plug to be placed in the cavity; assembling the container with the extrusion die so that the plug of the container is disposed in the conical cavity, of which an end is inserted in the opening with a desired gap therebetween; inserting a number of hot metal billets into the holes of the container; inserting an extrusion punch which has at least one pressing rod, into the holes of the container; and pressing the hot metal billets toward the conical cavity of the extrusion die so that the hot metal billets are mixed in and extruded out of the conical cavity of the extrusion die while the plug of the container guides a mixture of the metal billets through the opening of the extrusion die, wherein the conical cavity is defined by an inner surface of the extrusion die, of which the opening has a sectional shape corresponding to that of the plug so that a gap is defined between the inner surface of the extrusion die and surfaces of the plug, the gap having width corresponding to a thickness of the curved tube and wherein the inner surface of the extrusion die has a different gradient corresponding to an incline of the plug to cause the extruded tube to be curved.

In order to establish the fourth object of the present invention, there is provided a method for manufacturing a curved metal rod which comprises the steps of: preparing a container which has at least one hole and an extrusion die having a conical cavity with an opening, the conical cavity being eccentric from an axis extending longitudinally the container and the extrusion die; assembling the container with the extrusion die; inserting a number of hot metal billets into the holes of the container; inserting an extrusion punch which has at least one pressing rod, into the holes of the container; and pressing the hot metal billets toward the conical cavity of the extrusion die so that the hot metal billets are mixed in and extruded out of the conical cavity of the extrusion die, wherein the conical cavity is defined by an inner surface of the extrusion die and wherein the inner surface of the extrusion die has a different gradient to cause the extruded rod to be curved.

BRIEF DESCRIPTION OF DRAWINGS

The nature and mode of operation of preferred embodiments of the present invention will now be more fully described in the following detailed description, taken with the accompanying drawings wherein.

BEST MODE FOR CARRYING OUT THE INVENTION

The device of the present invention is intended to be installed in a hot metal extrusion machine so that the present invention can be utilized for manufacturing of curved metal tubes (100) or rods (200).

FIGS. 1 to 5 illustrate the device for manufacturing the curved metal tube having a rectangular shape in section according to an embodiment of the present invention.

According to the embodiment of the present invention, the device for manufacturing the curved metal tube includes an extrusion punch which has at least one pressing rod to press at least one hot metal billet, a container which has at least one hole corresponding to the number of the pressing rods and which has a plug extending from an end surface thereof and being eccentric from a center portion of the end surface of the container, for receiving the hot metal billet in a respective hole, and an extrusion die having a conical cavity with an opening, the conical cavity being eccentric from an axis extending longitudinally the container and the extrusion die in order for the plug to be placed in the cavity.

The conical cavity is defined by an inner surface of the extrusion die, of which the opening has a sectional shape corresponding to that of the plug so that a gap is defined between the inner surface of the extrusion die and surfaces of the plug. The gap has width corresponding to a thickness of the curved tube. The inner surface of the extrusion die has a different gradient corresponding to an incline of the plug to cause the extruded metal tube to be curved.

For more explanation of the detailed manufacturing process, first, the four hot metal billets(B) heated to the degree of hot extrusion temperature are inserted into the multi-hole container(C) with four holes(2), are pushed and moved by four punches(1) loaded with the compressive force, and are extruded to one circular tube welded together in the circumferential groove(5) passed through and connected to the four holes(2) at the lower part of multi-hole container(C).

Next, the one extruded circular tube welded in the circumferential groove(5) is pushed and passed through into the cavity(4) between the inner surface of the eccentric conical extrusion bending dies(D) and the outer surface of the eccentric conical plug(3).

Figure 1:
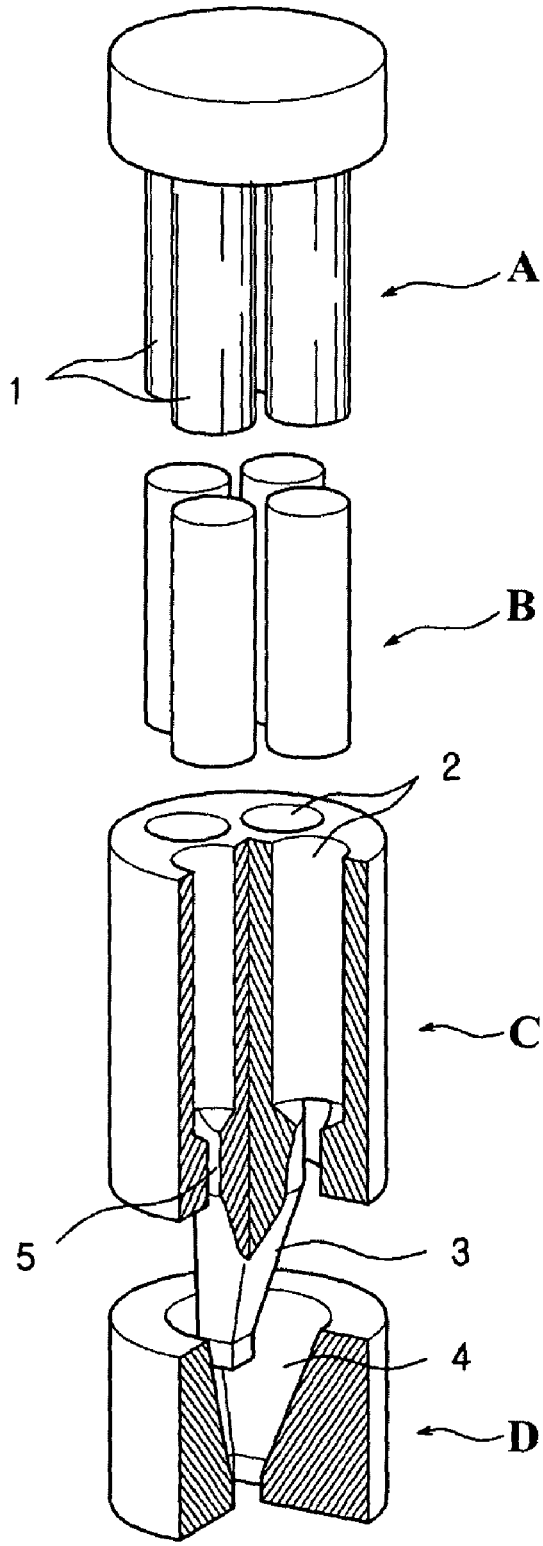
FIG. 1 is a partially sectional and perspective view of a device for manufacturing a curved metal tube having a rectangular shape in section, according to an embodiment of the present invention.
Figure 2:
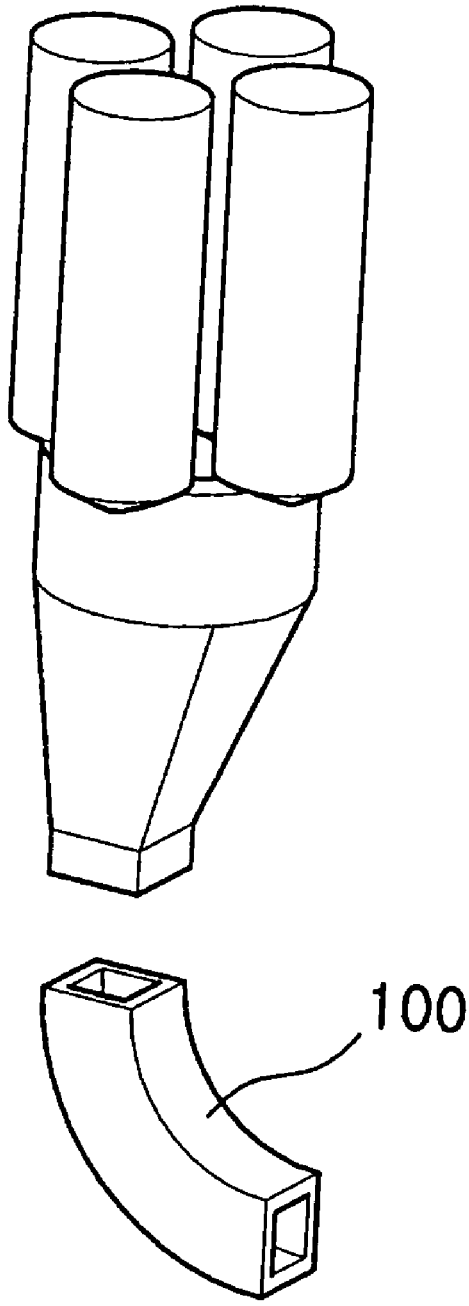
FIG. 2 is a perspective view of a plug and billets arranged around the plug of the device for manufacturing the curved metal tube having the rectangular shape in section, according to the embodiment of the present invention.
Figure 3:
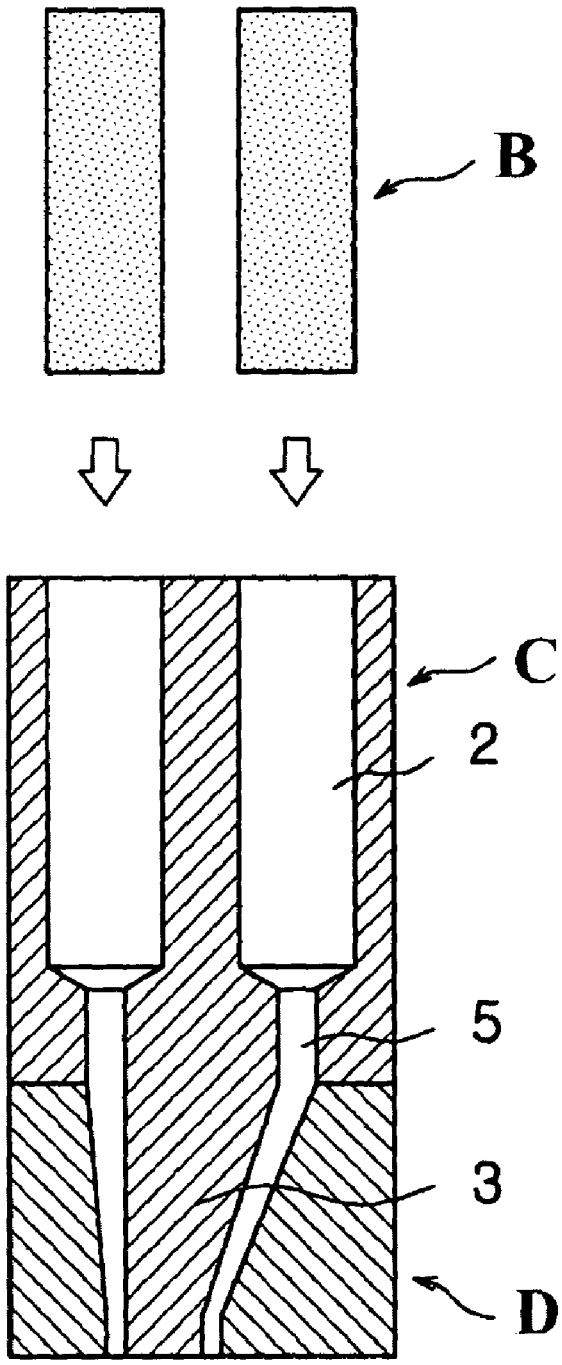
FIG. 3 is a sectional view of the device for manufacturing the curved metal tube having the rectangular shape in section according to the embodiment of the present invention, shown in FIG. 1, in which four metal billets are disposed in a container of the device.
Figure 4:
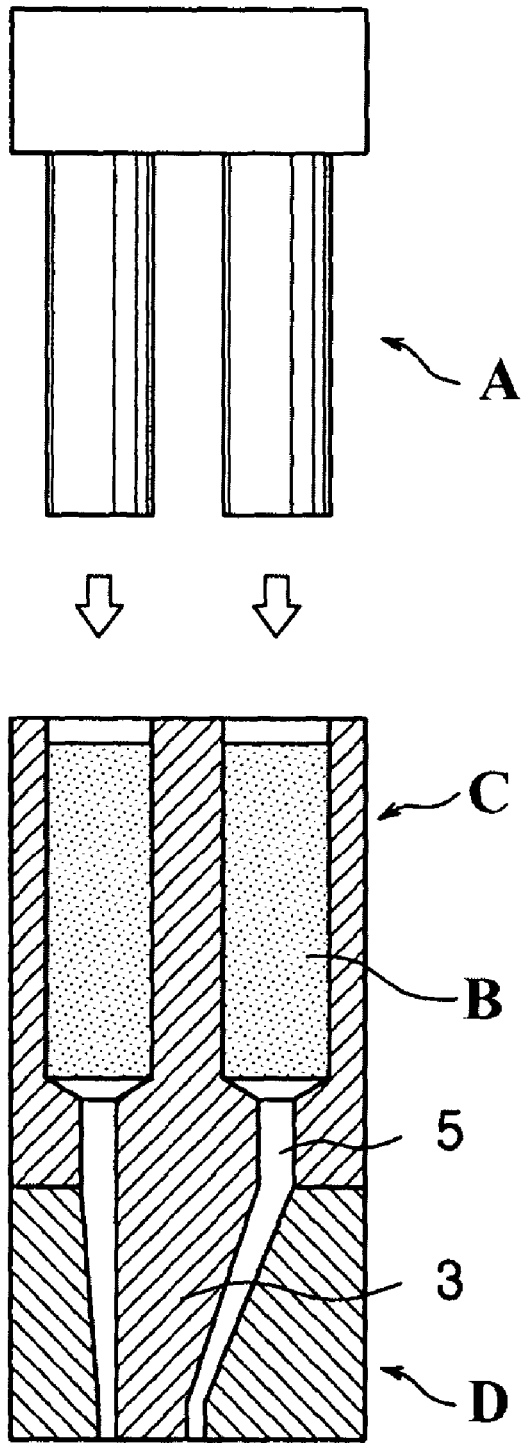
FIG. 4 is a sectional view of the device for manufacturing the curved metal tube having the rectangular shape in section according to the embodiment of the present invention, in which a punch having four rods moves to press the metal billets in the container of the device.
Figure 5:
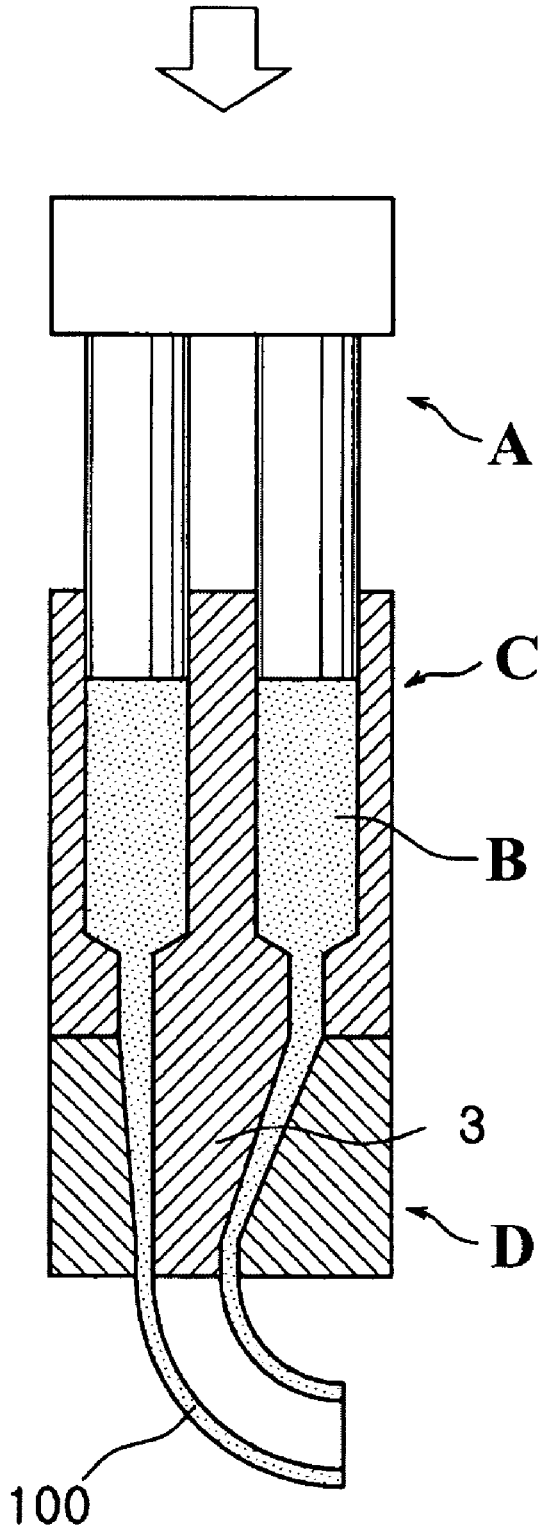
FIG. 5 is a sectional view of the device for manufacturing the curved metal tube having the rectangular shape in section according to the embodiment of the present invention, in which the punch having the four rods is pressing the metal billets in the container of the device in order to extrude the curved tube.

And the gradient of the extrusion velocity on the exit cavity section of conical extrusion bending dies(D) due to the eccentricity in the conical plug(3) and in the conical extrusion bending dies(D) should make bending in the extruded product to the opposite direction of the eccentricity of the conical extrusion dies(D), as shown in FIG. 5.

And the curvature of the extruded product, that is, the amount of bending of rectangular curved tube(100) can be controlled by the eccentricity between the circular cavity section in the circumferential groove(5) at the dies entrance and the rectangular cavity section at the dies exit, or it can be controlled by the changing the relative diameter of the two symmetric holes(2) of the multi-hole container(C), or it can be controlled by the relative moving velocity of two symmetric punches(1) inserted into the four hole(2).

And it is possible to manufacture the curved metal tube (100) whose curvature varies on the length of extruded product due to the gradient of the moving velocities of each billet controlled by the relative moving velocity of two symmetric punches(1) during the extrusion process.

In brief summarization of the extrusion bending process of curved tubes, first, the four hot metal billet(B) are welded together in the circumferential groove(5) and they are extruded to one circular tube, when one circular tube is pushed and passed through into the die cavity(4) between the dies surface and the plug surface, and then the bending should happen due to the gradient of extrusion velocity during the extrusion such that the moving velocity in left side is faster than the velocity in right side as shown in FIG. 5. The curvature of the curved product can be controlled by the eccentricity or by the relative diameter of four holes(2) or by the relative velocity of four punches(1).

Figure 8:
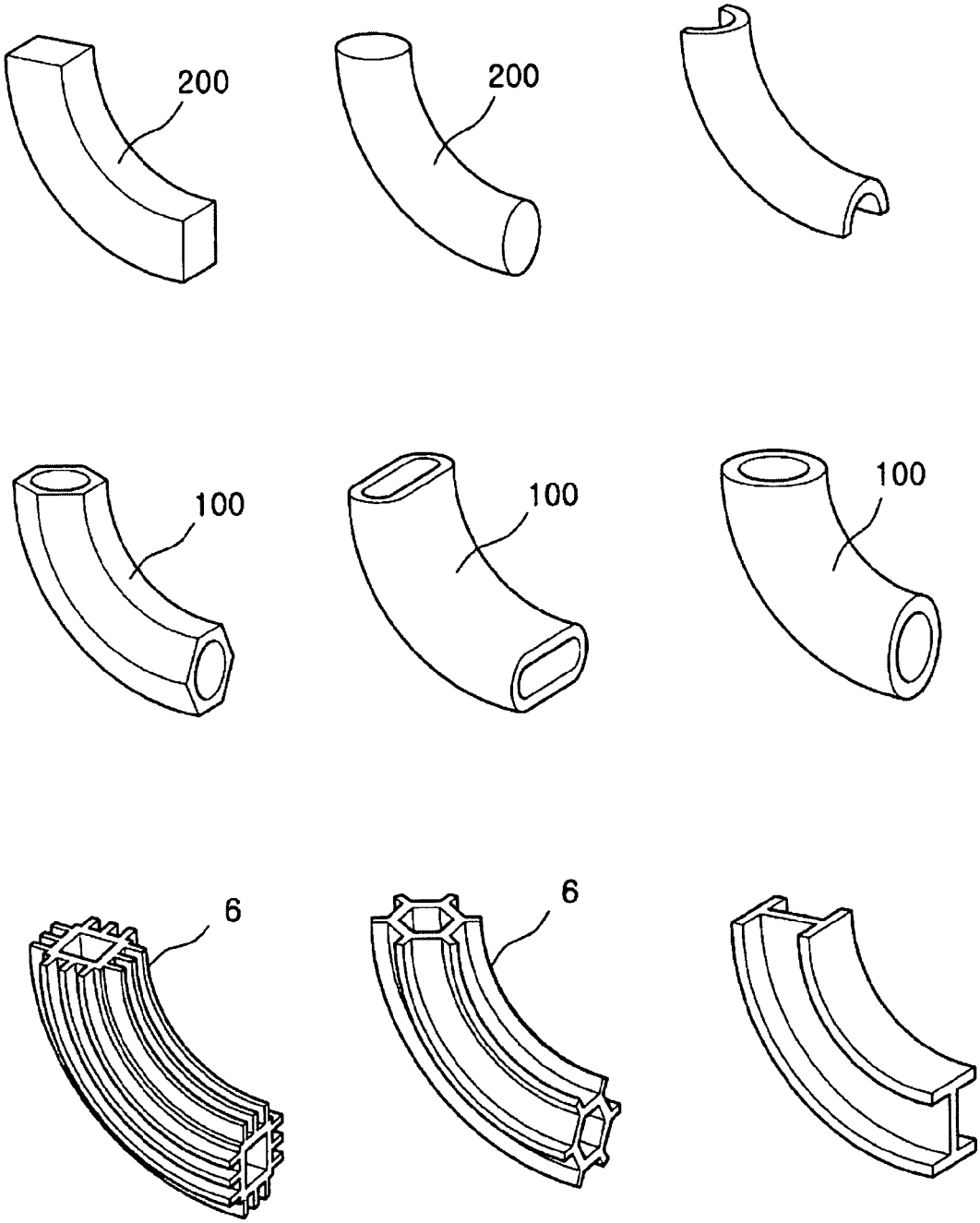
FIG. 8 shows products such as the curved metal tubes or rods which are manufactured by means of the devices according to the present invention.

Although the present example for the embodiment is illustrated in the case of the manufacturing of rectangular curved metal tube(100), however, according to the shape of the end of conical plug(3) connected to the multi-hole container(C) and to the shape of opening of the conical extrusion dies(D), it is possible to manufacture easily the products like as cylindrical and polygonal thin curved tube (100) with longitudinal fins(6) inside or outside of tube wall as shown in FIG. 8, and the curvature of the products can be controlled preciously in a variety of range by the eccentricity or by the relative size of multi-holes(2) or the relative moving velocity of multi-punches (1).

Figure 6:
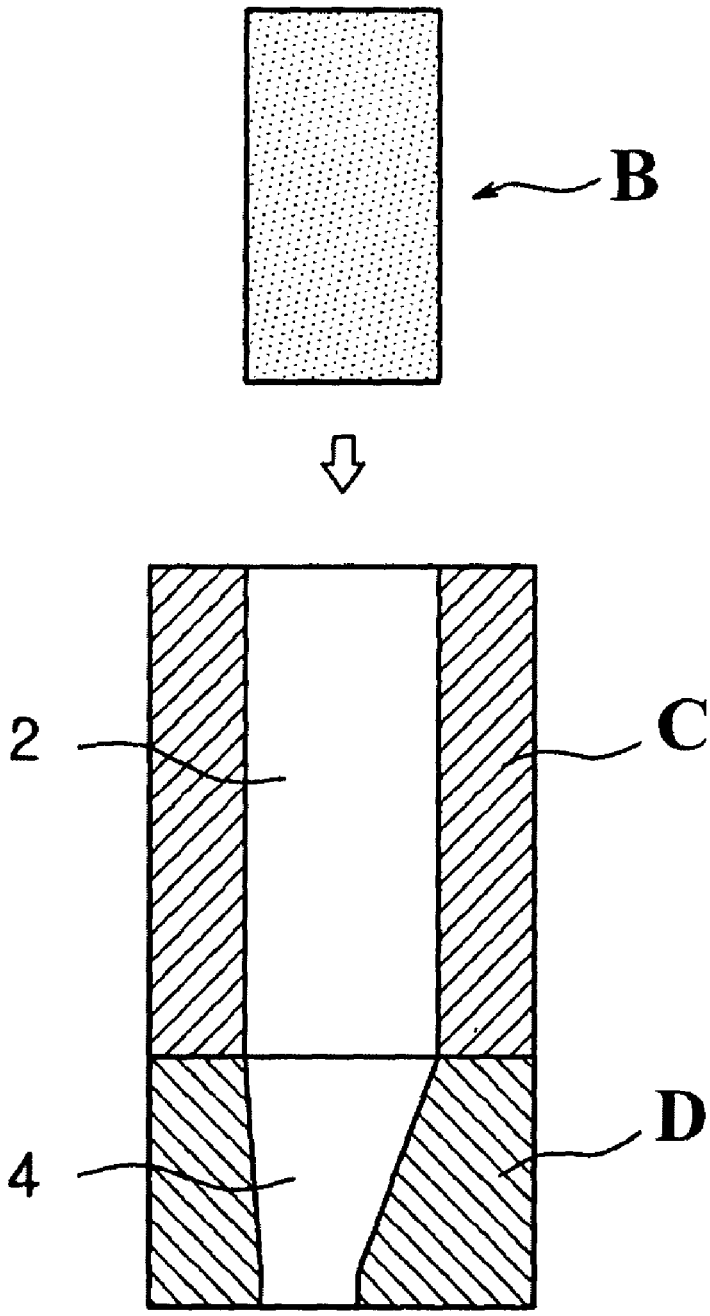
FIG. 6 is a sectional view of a device for manufacturing a curved metal rod having a rectangular shape in section according to the other embodiment of the present invention, which shows a billet to be inserted in a container of the device.
Figure 7:
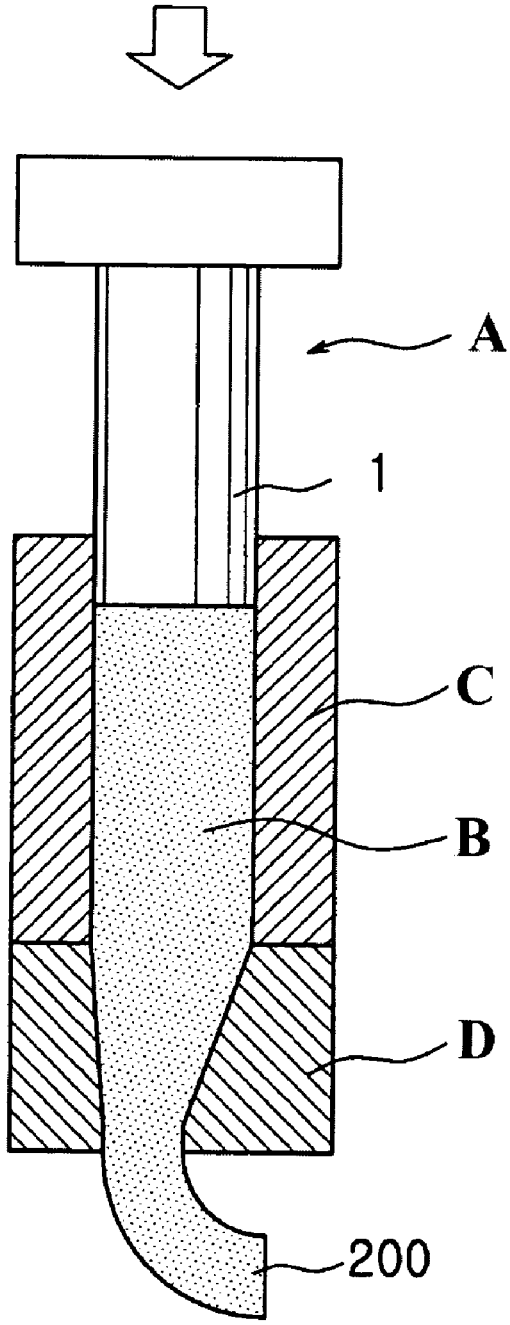
FIG. 7 is a sectional view of the device for manufacturing the curved metal rod having the rectangular shape in section according to the other embodiment of the present invention, which shows the billet disposed in the container of the device.

And, as shown in FIGS. 6–7, in the case of the manufacturing of curved metal rod(200), after that the one or more hot metal billets(B) are inserted into multi-hole container(C) with one or more holes(2) and they are pushed by multi-punches(1), they are welded together in the eccentric conical extrusion bending dies cavity(4) without the conical plug(3) connected to multi-hole container(C), and it is extruded to an arbitrary shaped curved metal rod(200), and when it is extruding in the dies cavity, the bending should happen by the gradient of extrusion velocity during the extrusion such that the moving velocity in left side is faster than the moving velocity in right side as shown in FIGS. 6–7.

The curvature of the curved metal rod(200) can be controlled by the eccentricity between an arbitrary cavity section at the dies entrance and an arbitrary cavity section at the dies exit or by the relative diameters of multi-holes(2) or by the relative moving velocity of multi-punches(1).

Although the two exemplary embodiments are illustrated as desirable examples of the case of the extrusion bending process with four hot billets(B) and four punches(1) and four-hole container(C), however, the fulfillment with the technically applicable range of the present invention can be made in any other case of the extrusion bending process using with one or more billets(B), with one or more punches (1), and with one or more holes(2).

INDUSTRIAL APPLICABILITY

The present invention is attributed to the increase of the productivity by combining extrusion process and bending process, so that the cost of production should be deceased by manufacturing curved metal products simultaneously in the one extrusion bending process of the present invention. And it is possible to manufacture the curved tubes and rods without defects such as wrinkling and folding on the surface, and such as distortion in the section, and thickness change of the wall to be occurred easily when the non-symmetric hollow tubes and rods with longitudinal fins(6) should be bended.

The invention claimed is:

1. A manufacturing device for a curved metal tube with an arbitrary section comprising:

an extrusion punch having two or more punches for pressing two or more hot metal billets(B), the two or more punches moveable at different velocities;

a container having a longitudinal axis, two or more holes for receiving each of the two or more hot metal billets, each of the holes being a different size, and an eccentric conical plug, extending from an end surface of the container, the plug being eccentric from the longitudinal axis of the container; and an eccentric conical extrusion bending die having an eccentric conical cavity with an opening, the conical cavity being eccentric from the longitudinal axis of the container, the eccentric conical cavity receiving the eccentric conical plug of the container, wherein the conical cavity defines an inner surface of the extrusion die, the opening of the conical cavity having a shape corresponding to the shape of the conical plug such that a gap is defined between the inner surface of the die and an outer surface of the conical plug, the gap having a width corresponding to the thickness of the curved metal tube, and wherein the inner surface of the extrusion die corresponds to the outer surface of the plug.

2. A manufacturing device for a curved metal rod with an arbitrary section comprising:

an extrusion punch having two or more differently moving punches for pressing two or more hot metal billets;

a container with two or more holes for receiving the two or more hot metal billets, each of the two or more holes being a different size; and an eccentric conical extrusion bending die having an eccentric conical cavity, the cavity surrounded by a ruled surface connecting an arbitrary contour of the entrance section of the conical die with an arbitrary contour of the section to be extruded at the conical die exit, wherein the cavity has an eccentricity such that the center of an arbitrary cavity section at the conical die entrance does not lie on the same line as a perpendicular line passing through the center of an arbitrary cavity section at the conical die exit.

3. A method of manufacturing a curved metal tube with an arbitrary section comprising:

providing a manufacturing device having a container with an eccentric conical die plug and two or more holes and a conical extrusion bending die, the conical plug and conical extrusion bending die being eccentric with respect to the manufacturing device, the conical extrusion bending die having a conical cavity for receiving the conical plug, the conical cavity corresponding to the conical plug; and extru-bending a hot metal billet by pushing the hot metal billet through the space between the eccentric conical plug and the eccentric conical extrusion die.

4. A method of manufacturing a curved metal tube with an arbitrary section comprising:

providing a manufacturing device having two or more punches, moving at different speeds, a container having two or more holes for receiving two or more hot metal billets, the two or more holes being different sizes, the container having an eccentric conical die plug extending therefrom, the manufacturing device further comprising a bending die having an eccentric conical cavity for receiving the conical die plug, the conical cavity corresponding to the conical die plug;

extru-bending the two or more hot metal billets by:

pushing the two or more hot metal billets of the two or more punches at different speeds into the two or more holes of the container; and welding together the two or more hot metal billets in the conical die cavity by passing the two or more hot metal billets through the space between the eccentric conical die plug and the eccentric conical die cavity.

* * * * *